US005516265A

United States Patent [19]

Harrison et al.

[11] Patent Number: 5,516,265

[45] Date of Patent: May 14, 1996

[54] INTERFACE APPARATUS FOR PERMITTING MICROPROCESSOR-BASED ELECTRONIC CONTROL OF NON-ELECTRONICALLY CONTROLLED AIR COMPRESSORS

[75] Inventors: Duane N. Harrison, Davidson; Marc A. Buhrmaster, Statesville, both of N.C.

[73] Assignee: Ingersoll-Rand Company, Woodcliff Lake, N.J.

[21] Appl. No.: 259,581

[22] Filed: Jun. 14, 1994

[51] Int. Cl.[6] ..... F04B 49/00

[52] U.S. Cl. ..... 417/12; 417/45; 415/51

[58] Field of Search ..... 417/12, 18, 44.2, 417/44.11, 45, 290; 415/15–51

[56] References Cited

U.S. PATENT DOCUMENTS

| | | | |
|---|---|---|---|
| 4,201,517 | 5/1980 | Ferguson | 417/12 |
| 4,218,191 | 8/1980 | Stewart . | |
| 4,277,862 | 10/1980 | Andrew et al. . | |
| 4,502,842 | 3/1985 | Currier et al. . | |
| 4,519,748 | 5/1985 | Murphy et al. . | |
| 4,526,513 | 7/1985 | Bogel | 417/18 |
| 4,604,036 | 8/1986 | Sutou et al. | 417/18 |
| 4,656,589 | 4/1987 | Albers et al. . | |
| 4,797,207 | 1/1989 | Honganen et al. | 417/18 |
| 4,807,150 | 2/1989 | Hobbs . | |
| 4,940,391 | 7/1990 | Elms et al. . | |
| 4,969,801 | 11/1990 | Haseley et al. | 417/18 |
| 4,975,024 | 12/1990 | Heckel | 417/18 |
| 4,976,588 | 12/1990 | Heckel | 417/18 |
| 5,043,926 | 8/1991 | Naka et al. . | |
| 5,054,995 | 10/1991 | Haseley et al. . | |
| 5,109,543 | 4/1992 | Dissosway et al. | 455/170.1 |
| 5,120,199 | 6/1992 | Youngs et al. . | |

*Primary Examiner*—Louis J. Casaregola
*Assistant Examiner*—Xuan M. Thai
*Attorney, Agent, or Firm*—Michael M. Gnibus

[57] ABSTRACT

An interface apparatus permits microprocessor-based control of an air compressor having no microprocessor-based control capabilities. The interface apparatus includes a signal converter for permitting bi-directional communication between the interface apparatus and a microprocessor-based air compressor sequencer. A processor has a predetermined logic routine which processes sequencer communication commands into electrical signals which control the operation of the compressor. The processor communicates with the signal converter. At least one AC switch selectively switches a predetermined AC voltage, on and off, in response to the logic routine. The at least one AC switch communicates with the processor. An AC voltage sensor communicates with the processor. At least one control signal is outputted from the interface apparatus to the air compressor. At least one status signal is inputted to the interface apparatus from the air compressor.

14 Claims, 2 Drawing Sheets

INTERFACE APPARATUS FOR PERMITTING MICROPROCESSOR-BASED ELECTRONIC CONTROL OF NON-ELECTRONICALLY CONTROLLED AIR COMPRESSORS

BACKGROUND OF THE INVENTION

This invention generally relates to air compressors, and more particularly to an interface apparatus which permits non-electronically controlled air compressors to be controlled by a microprocessor-based electronic controller, or microcontroller.

Significant advancements have been achieved in the field of electronic control devices for air compressors. These electronic control devices may include state of the art microprocessor-based compressor controllers or compressor microcontrollers, and microprocessor-based air compressor sequencers. Both the compressor microcontrollers and the microprocessor-based air compressor sequencers may perform a multitude of compressor control functions.

It is known to operably connect a plurality of compressor microcontrollers to a microprocessor-based compressor sequencer to significantly increase the operational effectiveness and the efficiency of a plurality of microprocessor controlled air compressors in a compressed air distribution system. However, to date, non-electronically controlled air compressors have been unable to achieve such operational benefits. The microprocessor-based compressor sequencers have been unable to directly connect to the non-electronically controlled compressors because these compressors have lacked the requisite electronic circuitry.

In compressed air distribution systems, such as those designed to furnish compressed air to a variety of remote utilization sites in an industrial environment, the use of multiple air compressors to supply the distribution system with air under pressure is commonplace. The compressor units are generally cycled on or off, i.e. loaded or unloaded, as a function of the demand placed on the compressed air system. Heretofore, non-electronically controlled compressors have been sequenced and controlled by an apparatus which includes a series of mechanical or electro-mechanical relays.

Presently, it is common for a single industrial compressed air distribution system to include both compressors which are controlled by state of the art microcontrollers, and compressors which are controlled by the mechanical or electro-mechanical compressor control systems. Therefore, in such compressed air distribution systems there is a need to employ two types of compressor sequencing devices. This, of course, increases overhead costs and reduces operational efficiencies by preventing the plurality of different air compressors from being completely integrated into the compressed air distribution system.

The foregoing illustrates limitations known to exist in present air compressor distribution systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an interface apparatus for use in combination with a microprocessor-based air compressor sequencing apparatus and an air compressor which includes a load solenoid valve and a pressure sensing switch. The interface apparatus includes a signal converting means for converting input signals from the sequencer to a predetermined usable signal for the interface apparatus, and for converting output signals from the interface apparatus to a predetermined usable signal for the sequencer. A processor has a predetermined logic routine which processes sequencer communication commands into electrical signals which control the operation of the compressor. The processor communicates with the signal converting means. At least one AC switch selectively switches a predetermined AC voltage, on and off, in response to the logic routine. The at least one AC switch communicates with the processor. An AC voltage sensor communicates with the processor. At least one control signal is outputted from the interface apparatus to the air compressor. At least one status signal is inputted to the interface apparatus from the air compressor.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
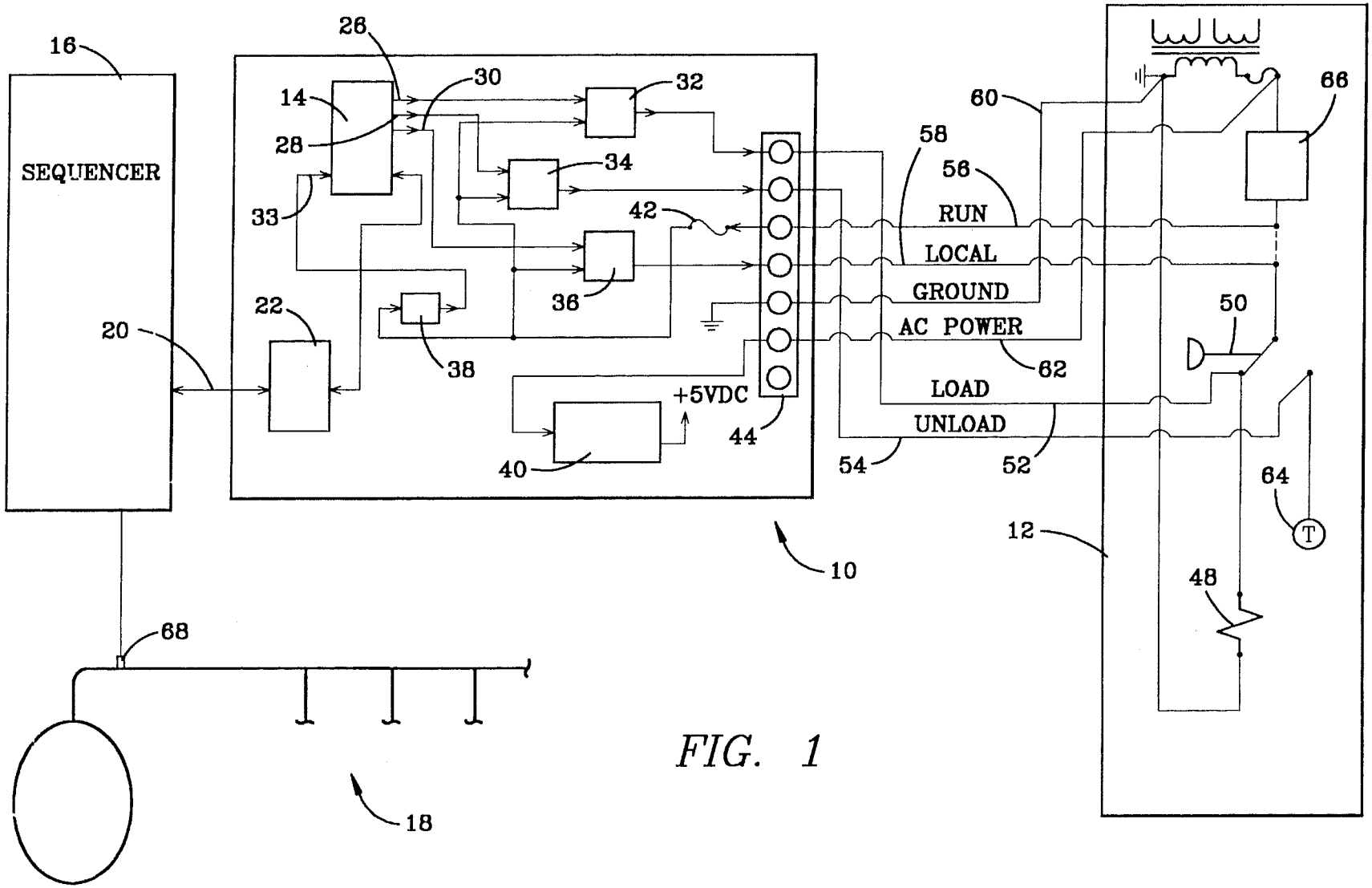
FIG. 1 is a functional block diagram of the apparatus of the present invention in combination with an air compressor which is controlled by an electro-mechanical compressor controller.

Referring now to the drawings, FIG. 1 illustrates an electronic interface apparatus 10 which permits a non-electronically controlled air compressor 12 to be controlled by a microprocessor-based electronic controller, or microcontroller 14. The interface apparatus 10 is shown operably connected to a microprocessor-based sequencer 16 which is disposed in pressure sensing relation to a compressed air distribution system which is partially illustrated at 18. As illustrated in FIG. 1, an individual interface apparatus 10 is operably connected to an individual non-electronically controlled air compressor 12.

An RS485 bus 20 is employed as a serial communication link between the sequencer 16 and the interface apparatus 10. The RS485 bus 20 is inputted to a communication port 22 of the interface apparatus 10. The communication port 22 is a 485/TTL type differential bus transceiver which is used as a signal converter for permitting bi-directional communication between the sequencer 16 and the interface apparatus 10. The communication port 22 converts input signals from the sequencer 16 for use by the interface apparatus 10, and converts output signals from the interface apparatus 10 for use by the sequencer 16. More particularly, the communication port 22 includes a 75176 type microchip which is employed to convert the serial RS485 signal, which is sent by the sequencer 16, to a TTL type signal level for use by the microcontroller 14 of the interface apparatus 10. The protocol for communications for the interface apparatus 10 comprises a half duplex signal with no parity, transmitted at 9600 baud, with 1 start bit, 8 data bits and 2 stop bits. The sequencer 16 will initiate any transmission. Transmissions from the apparatus 10 will be in response to the sequencer 16. If there elapses a time period of more than one second during which the apparatus 10 does not receive a signal from the sequencer 16, the compressor 12 will begin to operate under its own control.

The microcontroller 14 is an 87C51 type microcontroller with built in EPROM. The microcontroller 14 has a predetermined operations logic routine which controls operation of the interface apparatus 10. The predetermined logic routine is stored in the EPROM, and this logic routine is outlined in the flowchart of FIG. 2. The microcontroller 14 processes the serial communications from the communication port 22. The microcontroller 14 process signals to three outputs 26, 28, and 30, which supply, respectively, an unload signal, a "unload" signal, and a "load" signal to the compressor 12. Also, the microcontroller processes input data from an input 33 which inputs a "run" signal from the compressor 12 to the microcontroller 14.

Blocks 32 and 34 represent AC switches which are TRIAC type outputs from the microcontroller 14 which operate to selectively switch 115 VAC (volts AC) on and off, in response to the operations logic routine, to control operation of the compressor 12. AC switch 32 is the "load" output to the compressor 12, and AC switch 34 is the "unload" output to the compressor. Block 36 is an AC switch which is a mechanical relay type switch which operates to selectively switch 115 VAC on and off, in response to the operations logic routine, to control operation of the compressor 12. AC switch 36 is the "local" output to the compressor 12, and this AC switch permits the compressor 12 to operate locally, i.e. not in a "sequenced" mode.

Block 38 is a 115 VAC sense monitor for determining the presence of a 115 VAC "run" signal sent from the compressor 12. If the 115 VAC sense monitor senses the presence of the 115 VAC "run" signal, the microcontroller 14 permits the interface apparatus to determine, via the operation logic routine, that the compressor 12 is in a "run" state or a "ready to run" state. In the preferred embodiment of the present invention, the 115 VAC sense monitor is a type MID 400 which may be purchased from the General Instrument Corporation, New York, N.Y.

Block 40 is a transformer which receives 115 VAC and converts this voltage to 5 VDC (volts DC) for supplying power to the microcontroller 14 and the other electronic components of the interface apparatus 10. Fuse 42 limits the amount of current which may be switched through the AC switches 32, 34 and 36. A terminal block 44 provides for a connection for receiving the various output and input leads between the interface apparatus 10 and the compressor 12. Various output and input leads are connected at the terminal block 44 including a "load" lead 52, an "unload" lead 54, a "run" lead 56, a "local" lead 58, a "ground" lead 60, and an "AC power" lead 62.

In order for the interface apparatus 10 to operate in accordance with the teachings disclosed herein, the non-electronically controlled air compressor 12 shall include at a minimum various predetermined mechanical and electromechanical control assemblies. More particularly, the compressor 12 shall include a means for loading and unloading the compressor in response to a predetermined signal, such as an electric signal. This means for loading and unloading the compressor 12 may comprise a load solenoid valve or a solenoid and valve assembly 48. Additionally, the air compressor 12 shall include a means for sensing a compressed air distribution system pressure, such as a conventional pressure sensing switch 50.

The "load" lead 52 connects to the load solenoid valve 48. As should be understood, when the compressor 12 is not in a "local" operation mode, i.e. when the compressor 12 is receiving load and unload commands from the sequencer 16 through the interface apparatus 10, the pressure switch 50 is bypassed.

Some type compressors 12 are equipped with an automatic stop time-out feature which includes a means for timing out a predetermined time interval. More particularly, if a compressor 12 is unloaded for a predetermined period of time, the compressor is automatically shutdown. If such a timing means 64 is present, the "unload" line 54 provides a necessary "unload" signal which powers the timer to permit its function during operation of the compressor 12. The "unload" signal is continuously provided to the timer until such time when the machine is to be loaded, at which time the "unload" signal is terminated and the "load" signal is sent to the compressor 12.

The "run" line 56 permits a "run" signal to be transmitted to the interface apparatus 10. The "run" line 56 is connected to a run control switch 66 which may be connected to any number of compressor control switches such as an emergency stop switch (not shown) or a temperature high switch (not shown). As should be understood, as long as one of the compressor control switches is not positioned in a predetermined compressor shutdown position, a signal is sent through the run control switch 66 to the interface apparatus 10. This "run" signal permits the microcontroller 14 to determine whether the compressor 12 is running, or ready to run. If a predetermined condition exists wherein the compressor must be placed in a "local" mode, such as if the sequencer fails or if the sequencer 16 commands the interface apparatus 10 to place the compressor 12 in a "local" mode, such as to perform maintenance, then the "run" signal is diverted out of the interface apparatus 10 through the "local" line 58 which is connected to the input of the pressure switch 50.

The sequencer 16 is a microprocessor-based system for controlling the operation of one or more air compressor(s). In particular, the sequencer 16 includes an 87C51 microprocessor with built in EPROM and associated control logic, as well as an operator interface which includes a display and a keypad (not shown). The sequencer also includes a pressure transducer 68 which is mounted in pressure sensing communication with the compressed air distribution system 18, and which is connected to the sequencer microprocessor which includes an internal system clock (not shown).

Typically, the sequencer 16 controls between two and eight compressors 12. The sequencer 16 permits an end user to preselect up to eight different sequences in which the compressors 12 are to be loaded. More particularly, each compressor 12 is given a letter designation, A–H. The end user may thus enter up to eight sequences via the keypad by sequentially entering the letter designations of the compressors. The compressors will be loaded in the same order in which their letter designations were entered. For example, a sequence of ACDBHFEG would dictate that compressor A be loaded first, followed by compressor C, then compressors, D, B, H, F, E, and G, in turn. Further, the most recently loaded compressor is always the first compressor to be unloaded. If less than eight compressors are connected to the sequencer, the sequence need only include the letter designation of the available compressors.

The sequencer 16 permits three modes of operation of the compressors, namely, a "timed mode", an "event mode" and a "manual mode". In the "timed mode", an end user initially enters the length of time for the sequencer to operate in each sequence. For example, if one hour is entered as the length of time for operation of each sequence, the sequencer 16 would load the compressors according to the first sequence for the first hour, the second sequence for the second hour, the third sequence for the third hour and so on. The compressors would again be loaded according to the first sequence once each preselected sequence has been used.

In the "event mode", an end user may designate a particular sequence for each of up to nine events. Each event is defined by a user-designated day and time for its commencement as well as a sequence. Thus, the sequence corresponding to the current event, as determined by the user-designated event starting time and the internal clock of the sequencer 16, will control the loading and unloading of the compressors. The sequence corresponding to the current event will continue until the starting time designated for the next preselected event is reached, at which time the sequence corresponding to the next event controls the loading and unloading of the compressors.

In the "manual mode", a single sequence is entered by the end user which will run continuously until the end user operator places the sequencer 16 in either the "timed mode" or the "event mode". The manual mode is particularly useful for selecting a sequence such that maintenance may be performed on the compressors which are unloaded or off.

The sequencer 16 also includes a method of transitioning between sequences, which provides for a gradual transition from the prior sequence to the current sequence. Accordingly, the compressors which were loaded according to the prior sequence are not immediately unloaded and the compressors which are designated according to the current sequence are not immediately loaded. Instead, the transitioning method allows the compressors to be loaded and unloaded according to variations in demand which gradually shifts the loaded compressors to those selected according to the current sequence.

The pressure transducer 68 monitors the system pressure level. The pressure transducer 68 produces a signal having a frequency corresponding to a predetermined system pressure level which is transmitted to the sequencer microprocessor. The pressure transducer 68 may be calibrated by venting the transducer to the atmosphere, and by providing compensation in the control logic for the amount of variance of the transducer's output from a zero pressure reading.

In operation, the end user initializes the sequencer 16 by entering the number of compressors as well as the current day and time. The end user also enters the sequences in which the compressors 12 are to be loaded and unloaded as well as the target system pressure and the range of acceptable system pressures. The range of acceptable pressure may be selected from 2 to 10 psi. Thus, for example, a target system pressure of 100 psi and an acceptable range of 8 psi may be entered. Thus, the system pressure would be within the desirable pressure range from 96 psi to 104 psi. The end user also enters the delay load time and the delay unload time, as explained more fully below.

Following these selections, the sequencer 16 loads compressors according to the current sequence in order to build the air pressure of the compressed air distribution system 18 to a predetermined level, as measured by the pressure transducer 68, within the range of acceptable values. Thereafter, the pressure transducer 68 monitors the pressure of air system. The sequencer microprocessor receives the system pressure readings from the transducer 68, and unloads compressors 12 according to the current sequence if the system pressure exceeds the maximum acceptable pressure as defined by the target system pressure and the range of acceptable pressures. Similarly, the sequencer microprocessor loads additional compressors 12 according to the current sequence if the system pressure falls below the minimum acceptable system pressure.

The preselected delay load time and the delay unload time are the lengths of time allowed for the system to respond to the loading and unloading, respectively, of an individual compressor 12. For example, if the system pressure falls below the minimum acceptable system pressure, a compressor will be loaded. Prior to loading another compressor in order to further boost the system pressure above the minimum acceptable pressure level, however, the sequencer 16 will wait the preselected delay load time to determine if the system pressure has risen within the acceptable range of pressures by the prior loading of the first compressor so that the loading of another compressor is unnecessary.

Figure 2:
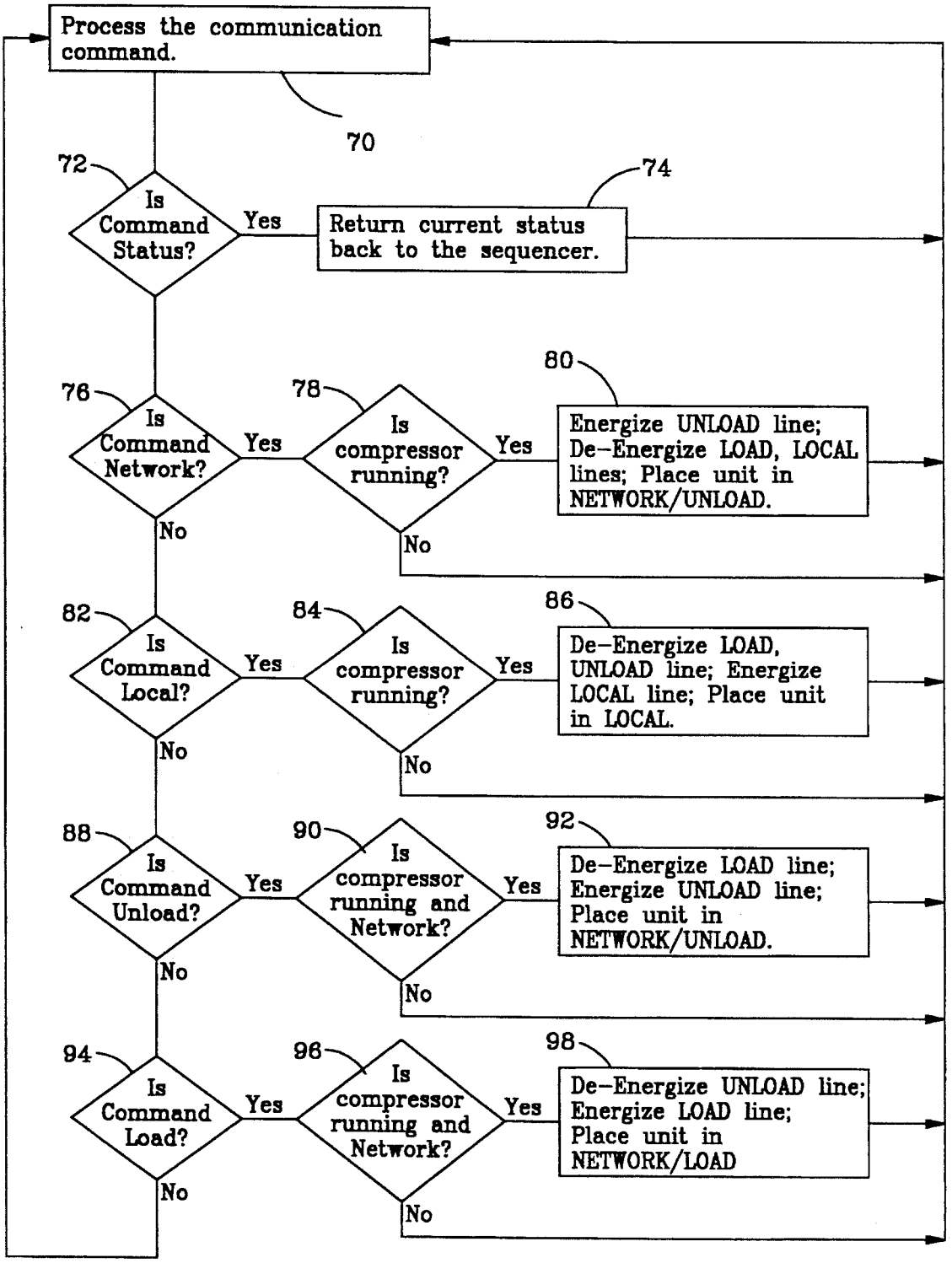
FIG. 2 is a flowchart of a logic routine which controls the operations mode of the apparatus of the present invention.

FIG. 2 is a flowchart of the operations logic routine used by the interface apparatus 10 to control an individual compressor 12 in response to the commands received by the sequencer 16. This logic permits the interface apparatus 10 to convert communication commands originating from the sequencer 16 into electrical signals so that the compressor 12 can operate under sequence control. At step 70, the microprocessor 14 preprocesses communications to and from the interface apparatus 10.

At step 72 a query is made regarding whether the communication from step 70 is a "status" type communication. If the communication is a "status" communication, then at step 74 a "current status" update communication is sent to the sequencer 16, and the logic routine returns back to step 70. If the communication from step 70 is not a "status" type communication, then at step 76 a query is made regarding whether the communication from step 70 is a "network" command.

If the communication from step 70 is a "network" command, at step 78 a query is made regarding whether the compressor 12 is running, i.e. operational. If the compressor 12 is running, at step 80 the following commands are delivered:

a) energize the "unload" line 54;

b) de-energize the "load" line 52 and the "local" line 58; thus placing the compressor 12 in a "network/unload" state. If the compressor 12 is not running, the logic returns back to step 70. If the communication from step 70 is not a "network" command, then at step 82 a query is made regarding whether the communication from step 70 is a "local" command.

If the communication from step 70 is a "local" command, at step 84 a query is made regarding whether the compressor 12 is running. If the compressor 12 is running, at step 86 the following commands are delivered:

a) de-energize the "load" line 52 and the "unload" line 54;

b) energize the "local" line 58; thus placing the compressor 12 in a "local" state. If the compressor 12 is not running, the logic returns back to step 70. If the communication from step 70 is not a "local" command, then at step 88 a query is made regarding whether the communication from step 70 is an "unload" command.

If the communication from step 70 is an "unload" command, at step 90 a query is made regarding whether the compressor 12 is running and networked, i.e. not in a "local" mode. If the compressor 12 is running and networked, at step 92 the following commands are delivered:

a) de-energize the "load" line 52;

b) energize the "unload" line 54; thus placing the compressor 12 in a "network/unload" state. If the compressor 12 is not running, the logic returns back to step 70. If the communication from step 70 is not an "unload" command, then at step 94 a query is made regarding whether the communication from step 70 is a "load" command.

If the communication from step 70 is a "load" command, at step 96 a query is made regarding whether the compressor 12 is running and networked. If the compressor 12 is running and networked, at step 98 the following commands are delivered:

a) de-energize the "unload" line 54;

b) energize the "load" line 52; thus placing the compressor 12 in a "network/load" state. If the compressor 12 is not running, the logic returns back to step 70. If the communication from step 70 is not a "load" command, the logic returns back to step 70.

While this invention has been illustrated and described in accordance with a preferred embodiment, it is recognized that variations and changes may be made therein without departing from the invention as set forth in the following claims.

Having described the invention, what is claimed is:

1. The combination comprising:

A) a non-electronically controlled air compressor comprising a load solenoid valve and a pressure switch;

B) a microprocessor-based sequencing apparatus; and

C) an interface apparatus operably connected to the sequencer and non-electronically controlled air compressor, the interface apparatus comprising: signal converting means for converting input signals from the sequencer to a predetermined usable signal for the interface apparatus, and for converting output signals from the interface to a predetermined usable signal for the sequencer;

a processor having a predetermined logic routine which processes sequencer communication commands into electrical signals which control the operation of the non-electronically controlled air compressor, the processor communicating with the signal converting means;

at least one AC switch which selectively switches a predetermined AC voltage, on and off, in response to the logic routine, the at least one AC switch communicating with the processor;

timer means for timing out a predetermined time period and wherein if there elapses a time period of more than one second during which the non-electronically controlled air compressor does not receive a predetermined control signal, the non-electronically controlled air compressor will begin to operate under its own control, means for sensing an AC voltage, the AC voltage sensing means communicating with the processor; and means for outputting at least one predetermined control signal from the interface apparatus to the non-electronically controlled air compressor and for inputting at least one predetermined status signal from the non-electronically controlled air compressor to the interface apparatus.

2. An interface apparatus, as claimed in claim 1, and wherein an RS485 bus is employed as a serial communication link between the sequencer and the interface apparatus.

3. An interface apparatus, as claimed in claim 2, and wherein the signal converting means is a 485/TTL type differential bus transceiver which permits bi-directional communication between the sequencer and the interface apparatus.

4. An interface apparatus, as claimed in claim 3, and wherein the signal converting means includes a 75176 type microchip which is employed to convert a serial RS485 signal, which is sent by the sequencer, to a TTL CMOS type signal level for use by the processor of the interface apparatus.

5. An interface apparatus, as claimed in claim 4, and wherein a half duplex, 9600 baud, 1 start bit, 8 data bits, 2 stop bits, and no parity structure is employed as a communication protocol.

6. An interface apparatus, as claimed in claim 1, and wherein the processor is an 87C51 type microcontroller.

7. An interface apparatus, as claimed in claim 6, and wherein the microcontroller has built in EPROM which has stored therein the predetermined logic routine which controls operation of the interface apparatus.

8. An interface apparatus for use in combination with a microprocessor-based air compressor sequencing apparatus and an air compressor which includes a load solenoid valve, a pressure sensing switch and timer means for timing out a predetermined time interval, the interface apparatus comprising:

signal converting means for converting input signals from the sequencer to a predetermined usable signal for the interface apparatus, and for converting output signals from the interface to a predetermined usable signal for the sequencer;

a processor having a predetermined logic routine which processes sequencer communication commands into electrical signals which control the operation of the air compressor, the processor communicating with the signal converting means and wherein an "unload" signal is continuously outputted to the timing means until a "load" signal is outputted to the air compressor;

at least one AC switch which selectively switches a predetermined AC voltage, on and off, in response to the logic routine, the at least one AC switch communicating with the processor;

means for sensing an AC voltage, the AC voltage sensing means communicating with the processor; and means for outputting at least one predetermined control signal from the interface apparatus to the air compressor and for inputting at least one predetermined status signal from the air compressor to the interface apparatus.

9. An interface apparatus for use in combination with a microprocessor-based air compressor sequencing apparatus and an air compressor which includes a load solenoid valve and a pressure sensing switch, the interface apparatus comprising:

signal converting means for converting input signals from the sequencer to a predetermined usable signal for the interface apparatus, and for converting output signals from the interface to a predetermined usable signal for the sequencer;

a processor having a predetermined logic routine which processes sequencer communication commands into electrical signals which control the operation of the air compressor, the processor communicating with the signal converting means, and wherein the processor processes a "load" output signal, a "local" output signal, and an "unload" output signal to the air compressor;

a pair of TRIAC type AC switches which selectively switch a predetermined AC voltage, on and off, in response to the logic routine, each of the AC switches communicating with the processor;

means for sensing an AC voltage, the AC voltage sensing means communicating with the processor; and means for outputting at least one predetermined control signal from the interface apparatus to the air compressor and for inputting at least one predetermined status signal from the air compressor to the interface apparatus.

10. An interface apparatus, as claimed in claim 9, and wherein the "load" output signal is outputted to the load solenoid valve of the air compressor through the first TRIAC type AC switch.

11. An interface apparatus, as claimed in claim 9, and wherein the "unload" output signal is outputted to the air compressor through the second TRIAC type AC switch.

12. An interface apparatus for use in combination with a microprocessor-based air compressor sequencing apparatus and an air compressor which includes a load solenoid valve and a pressure sensing switch, the interface apparatus comprising:

signal converting means for converting input signals from the sequencer to a predetermined usable signal for the interface apparatus, and for converting output signals from the interface to a predetermined usable signal for the sequencer;

a processor having a predetermined logic routine which processes sequencer communication commands into electrical signals which control the operation of the air compressor, the processor communicating with the signal converting means, and wherein the processor processes a "load" output signal, a "local" output signal, and an "unload" output signal to the air compressor;

at least one mechanical type AC switch which selectively switches a predetermined AC voltage, on and off, in response to the logic routine, the at least one AC switch communicating with the processor;

means for sensing an AC voltage, the AC voltage sensing means communicating with the processor; and means for outputting at least one predetermined control signal from the interface apparatus to the air compressor and for inputting at least one predetermined status signal from the air compressor to the interface apparatus.

13. An interface apparatus, as claimed in claim 12, and wherein the "local" output signal is outputted to the air compressor through the mechanical relay type AC switch.

14. An interface apparatus for use in combination with a microprocessor-based air compressor sequencing apparatus and an air compressor which includes a load solenoid valve and a pressure sensing switch, the interface apparatus comprising:

signal converting means for converting input signals from the sequencer to a predetermined usable signal for the interface apparatus, and for converting output signals from the interface to a predetermined usable signal for the sequencer;

a processor having a predetermined logic routine which processes sequencer communication commands into electrical signals which control the operation of the air compressor, the processor communicating with the signal converting means and wherein the processor processes a "load" output signal, a "local" output signal, and an "unload" output signal to the air compressor and also processes a "run" input signal from the air compressor;

at least one AC switch which selectively switches a predetermined AC voltage, on and off, in response to the logic routine, the at least one AC switch communicating with the processor;

means for sensing an AC voltage, the AC voltage sensing means communicating with the processor, and wherein the AC voltage sensing means determines the existence of the "run" input signal, which is a 115 VAC signal sent from the air compressor, and wherein the existence of the "run" signal establishes that the air compressor is in a "run" state or a "ready to run" state; and means for outputting at least one predetermined control signal from the interface apparatus to the air compressor and for inputting at least one predetermined status signal from the air compressor to the interface apparatus.

* * * * *